US005833147A

United States Patent [19]

Fuhlbrigge

[11] Patent Number: 5,833,147

[45] Date of Patent: Nov. 10, 1998

[54] ROTARY UNION FOR ROBOTIC END EFFECTOR

[75] Inventor: Thomas A. Fuhlbrigge, Auburn Hills, Mich.

[73] Assignee: ABB Flexible Automation Inc.

[21] Appl. No.: 782,779

[22] Filed: Jan. 13, 1997

[51] Int. Cl.[6] ..... B05B 15/08

[52] U.S. Cl. ..... 239/587.5

[58] Field of Search ..... 285/276, 275, 285/277; 239/587.5, 587.4, 227; 901/43

[56] References Cited

U.S. PATENT DOCUMENTS

| | | | |
|---|---|---|---|
| 2,562,556 | 6/1951 | Kurt | 239/227 |
| 3,464,632 | 9/1969 | Bristow | 239/227 |
| 4,355,827 | 10/1982 | Ehret | 285/276 X |
| 4,449,738 | 5/1984 | Hotger . | |
| 4,515,312 | 5/1985 | Manabe et al. | 239/227 |
| 4,592,495 | 6/1986 | Toda et al. . | |
| 4,767,257 | 8/1988 | Kato . | |
| 5,056,719 | 10/1991 | Lauter et al. | 239/587.5 X |
| 5,080,401 | 1/1992 | Stich | 285/276 X |
| 5,098,024 | 3/1992 | MacIntyre et al. . | |
| 5,188,293 | 2/1993 | Burton | 239/277 X |
| 5,320,283 | 6/1994 | Hollstein et al. . | |
| 5,496,075 | 3/1996 | Ostermann | 285/276 X |
| 5,538,189 | 7/1996 | Rodgers . | |

OTHER PUBLICATIONS

Talco Catalog page, "2200 Series Rotary Unions", Talco, Fridley, Minnesota.

*Primary Examiner*—Kevin Weldon
*Attorney, Agent, or Firm*—Harness, Dickey & Pierce, P.L.C.

[57] ABSTRACT

The present invention provides a rotary union interconnecting a material supply line and a dispense valve. Preferably, the rotary union comprises a rotatable member having a mounting end coupled to a rotating means and a dispense end including a conduit formed therein for dispensing a preselected material. According to the invention, a housing is rotatably supported about the rotatable member such that the rotatable member is rotatable relative to the housing. The housing includes an opening formed therein for communicating with the conduit and a material supply line. Even more preferably, the rotating means comprises a rotatable face plate operably coupled to a sixth axis motor of a multi-axis robot.

4 Claims, 2 Drawing Sheets

ROTARY UNION FOR ROBOTIC END EFFECTOR

BACKGROUND OF THE INVENTION

1. Technical Field

The present invention relates generally to a rotary union for a robotic end effector and more particularly to a rotary union for interconnecting a dispense valve and a material supply line.

2. Discussion

The use of robots to implement numerous manufacturing processes has increased dramatically in the last decade. Robots now perform various manufacturing operations such as dispensing, deburring, grinding, polishing, painting, finishing coating, cutting, welding, and others. A well-adjusted robot enables enhanced control and repeatability of a manufacturing process.

In one robotically implemented manufacturing process, structural components are secured together using a viscous adhesive applied by an automated robotic system. Materials such as PVC based sealants and adhesives, heat cure epoxies, two-component epoxies and others are typical of viscous materials commonly applied through use of robotic systems. Typically, a whip hose is utilized to deliver the viscous material from a gear pump to a dispense valve from which it is emitted.

Robotic dispensing systems generally dispense a bead of viscous material along a perimeter or other desired pathway of a structural member. Often, the adhesive bead is dispensed such that it maintains a desired shape over the entire pathway along the application area. For instance, a triangular-shaped bead is often applied about the perimeter of an automobile window opening such that the plane of the triangle is perpendicular to the window perimeter. To accomplish this, the robotic system is configured to rotate the dispense valve as the dispensing proceeds so that the orientation of the valve with respect to the structural member is controlled. Therefore, the dispensing orifice of the valve, which is shaped to emit the material in its predetermined form, dispenses the shaped bead of material in a proper orientation.

Commonly, the sixth axis of a multi-axis robot is utilized for orienting the dispense valve. Rotation of the dispense valve by the sixth axis causes the whip hose or material supply line, which is coupled to the dispense valve, to twist, wrench, flex, and unflex repeatedly. The material supply line also impinges upon the robot structure due to the rotation of the dispense valve. This contorting and impingement results in excessive fatigue and wear of the material supply line which results in the need to replace the lines once or twice per year.

One prior art attempt to reduce the wear of supply lines includes incorporating a plurality of swivels along the length of the material supply line. In this way, multiple sections of the supply line may rotate independently with respect to each other. However, this system is costly and complicated to implement. Further, its effectiveness at reducing wear is marginal.

Another attempt to reduce wear of supply lines has been through the use of rotary unions interposed between the material supply line and the dispense valve. Prior art rotary unions generally include a body communicating with the supply line. A first end of the body rotatably supports a shaft to which a dispense nozzle may be coupled. The second end of the body supports an end cap.

According to the prior art, the rotating shaft cannot be mounted to a face plate of a multi-axis robot. As such, the body must be secured to the robot with a first structural member while the dispense nozzle is rotated with a second structural member. Accordingly, implementing a dispensing operation using a conventional rotary union is difficult.

Therefore, it is an object of the present invention to provide a rotary union for rotatably interconnecting a material supply line and a dispense valve such that a mounting portion of a rotatable member of the union is directly securable to a face plate of a multi-axis robot and a conduit of the rotatable member fluidly communicates with the dispense valve. In this way, mounting and rotating of the rotary union may be accomplished through a single structural member.

SUMMARY OF THE INVENTION

The above and other objects are provided by a rotary union interconnecting a material supply line and a dispense valve. Preferably, the rotary union comprises a rotatable member having a mounting end coupled to a rotating means and a dispense end including a conduit formed therein for dispensing a preselected material. A housing is rotatably supported about the rotatable member such that the rotatable member is rotatable relative to the housing. The housing includes an opening formed therein for communicating with the conduit and a material supply line. Even more preferably, the rotating means comprises a rotatable face plate operably coupled to a sixth axis motor of a multi-axis robot.

BRIEF DESCRIPTION OF THE DRAWINGS

In order to appreciate the manner in which the advantages and objects of the invention are obtained, a more particular description of the invention will be rendered by reference to specific embodiments thereof which are illustrated in the appended drawings. Understanding that these drawings only depict preferred embodiments of the present invention and are not therefore to be considered limiting in scope, the invention will be described and explained with additional specificity and detail through the use of the accompanying drawings in which.

DETAILED DESCRIPTION OF THE PREFERRED EMBODIMENTS

The following description of the preferred embodiments is merely exemplary in nature and is in no way intended to limit the present invention or its application or uses.

The present invention is particularly concerned with providing a rotary union for a dispense valve to minimize the wear of a material supply line caused by rotating the dispense valve. As is known, many manufacturing applications require a bead of adhesive material to be robotically dispensed onto a structural member. Often, the cross-sectional shape of the desired bead and its orientation with respect to the structural member is essential to the manufacturing process. In these instances, it is necessary to continuously re-orient the adhesive dispense valve with respect to the structural member during dispensing of the adhesive. Over time, the repetitive rotation of the dispense valve damages the material supply line delivering the adhesive thereto. The present invention is directed toward providing a rotary union between the material supply line and the dispense valve which permits a fluidly communicating rotatable member of the rotary union to be mounted to a face plate of a multi-axis robot while a stationary housing supports the supply line.

Figure 1:
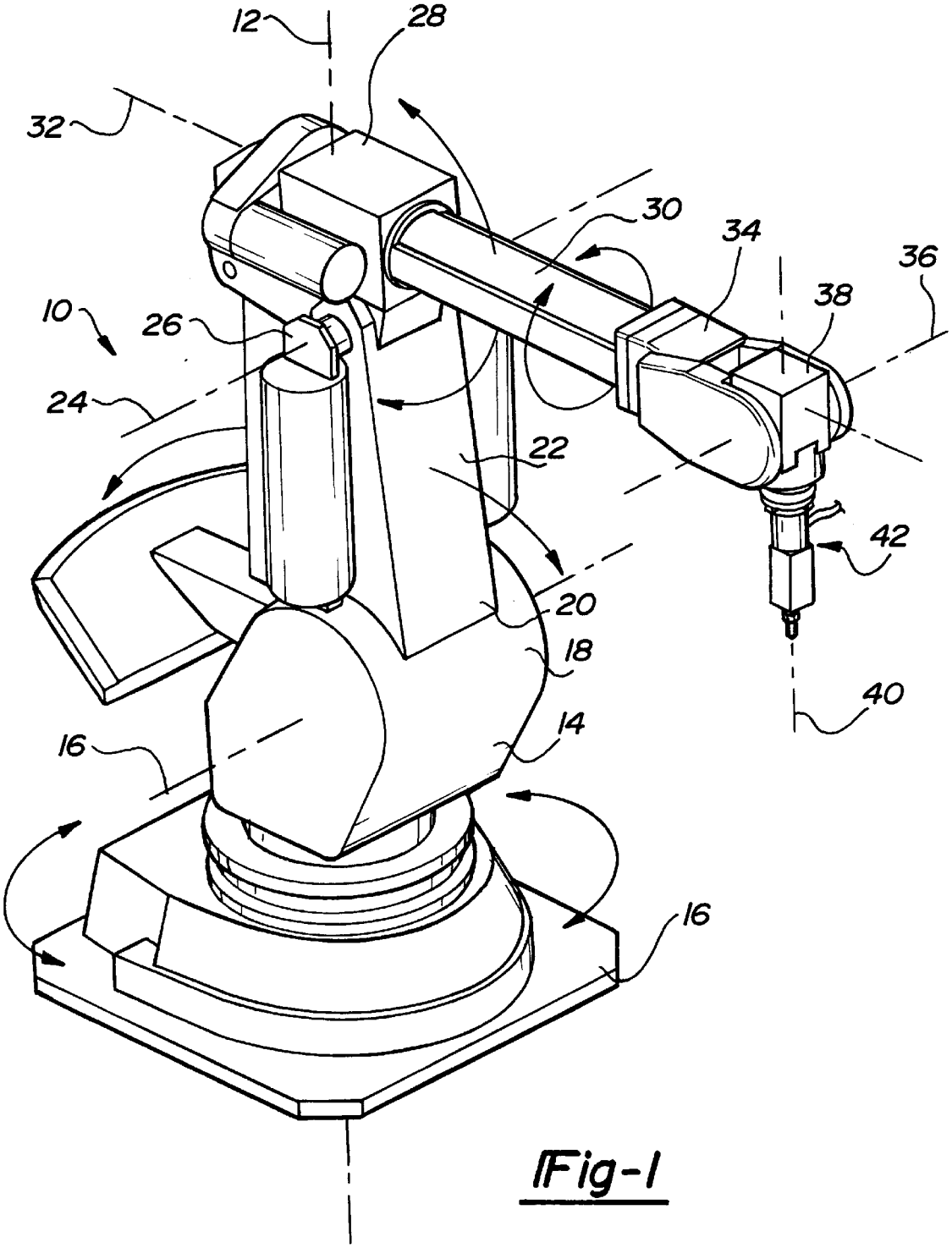
FIG. 1 illustrates a multi-axis robotic system having the rotary union of the present invention secured thereto.

Referring now to the drawings, a multi-axis robot is illustrated in FIG. 1 generally at 10. The multi-axis robot 10 includes six axes about which the robot 10 is positionable. These include a first rotational axis 12 extending vertically through the main body portion 14 of the robot and the base 15. The first axis 12 permits rotational movement of the body 14 with respect to the base 15. A second rotational axis 16 extends laterally through a distal end 18 of the main body portion 14 and a proximal end 20 of a support member 22. The second axis 16 permits the support member 22 to pivot with respect to the body 14. A third rotational axis 24 extends through a distal end 26 of the support member 22 and a proximal end 28 of an arm 30. The third axis 24 enables the arm 30 to pivot with respect to the support member 22.

A fourth rotational axis 32 extends longitudinally through the arm 30 and permits a distal end 34 of the arm 30 to rotate with respect to its proximal end 28. A fifth rotational axis 36 extends through the distal end 34 of the arm 30 and a wrist member 38. The fifth axis 36 enables the wrist 38 to pivot with respect to the arm 30. A sixth rotational axis 40 extends longitudinally through the wrist 38 and enables rotational actuation of end effector 42. As is known in the art, a motor and gear box are disposed along each axis to power the movements described above.

Figure 2:
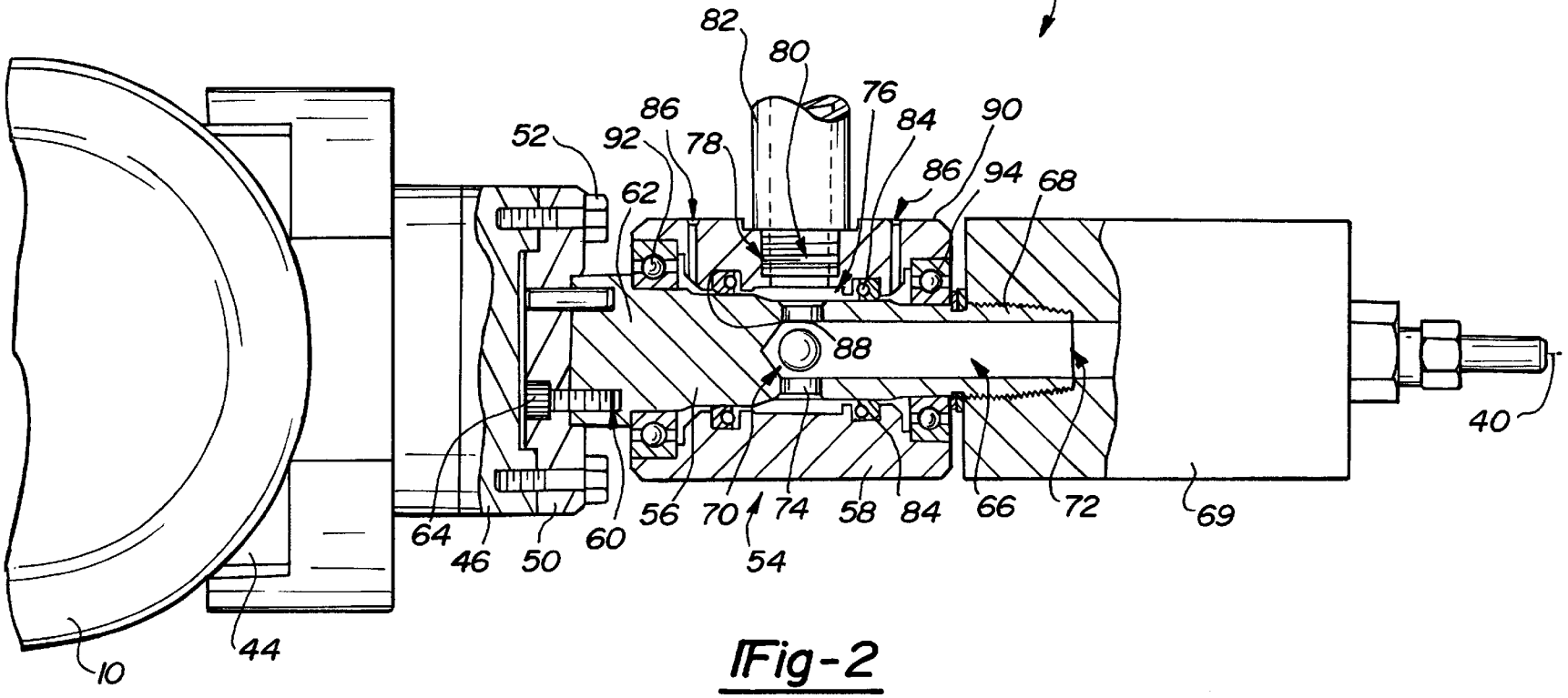
FIG. 2 is an enlarged cross-sectional view of the preferred embodiment of the rotary union of the present invention.

Turning now to FIG. 2, an enlarged partial cross-sectional view of the end effector 42 and robot 10 is shown. A sixth axis motor 44 is disposed with its axis of rotation along the sixth axis 40. A rotatable element or face plate 46 is operably coupled to the motor 44 such that operation of the sixth axis motor 44 rotates the face plate 46. A face plate adaptor 50 is secured to the face plate 46 through a plurality of threaded members 52. The face plate adaptor 50 permits mounting of various end effector components to a common face plate 46. In this case, a rotary union 54 is secured to the face plate adaptor 50.

Preferably, the rotary union 54 includes a rotatable member 56 rotatably disposed within a stationary housing 58. The rotatable member 56 includes a plurality of threaded openings 60 at a first end 62 adapted to receive a plurality of threaded members 64 for securing the rotary union 54 to the face plate adaptor 50. The rotatable member 56 also includes an elongated conduit 66 formed in a second end 68 thereof communicating with a dispense valve 69.

The elongated conduit 66 includes a viscous material receiving end 70 and a viscous material dispensing end 72. The viscous material receiving end 70 is constructed with a plurality of laterally extending channels 74 communicating with the elongated conduit 66. A void 76 is provided between the housing 58 and the rotatable member 56 which communicates with the channels 74.

The housing 58 also includes an opening 78 adapted to threadingly engage an end 80 of a material supply line 82. As such, the material supply line 82 delivers viscous material to the elongated conduit 66 via the opening 78, void 76, and channels 74. It should be noted that the dispense valve 69 may also be located upstream of the rotary union 54. In this case, it is preferable that the dispense valve 69 be interposed between the end 80 of the material supply line 82 and the opening 78 of the housing 58. According to this configuration, the dispensing end 72 of the elongated conduit 66 would serve to emit the viscous material to desired locations. Preferably, a dispense tip (not shown) of a predetermined shape would be secured to the dispensing end 72 such that the bead of viscous material is emitted in a preselected form.

Still referring to FIG. 2, a plurality of 0-ring type seals 84 are sealingly interposed between the housing 58 and the rotatable member 56. The seals 84 serve to isolate the viscous material within the void 76 such that leakage of the viscous material is prevented. A pair of weep holes 86 extend from an inner wall 88 of the housing 58 to an outer wall 90 of the housing 58 outboard of the seals 84. As such, any leakage of viscous material through the seals 84 is indicated by observing viscous material seeping from the weep holes 86.

First roller bearings 92 interconnect the housing 58 and the first end 62 of the rotatable member 56. Second roller bearings 94 interconnect the housing 58 and the second end 68 of the rotatable member 56. First roller bearings 92 and second roller bearings 94 rotatably support the housing 58 about the rotatable member 56. As such, the rotatable member 56 may rotate with respect to the housing 58 under the power of the sixth axis motor 44 while continuously maintaining fluid communication between the material supply line 82 and the conduit 66 via the opening 78, void 76, and channels 74. As can be seen, the single piece rotatable member 56 serves not only as a conduit of viscous material for the dispense valve 69, but also as the mounting structure to couple the rotary union 54 to the robot 10.

As best seen in FIG. 2, in operation viscous material is supplied by the material supply line 82 to the opening 78. The viscous material travels through the opening 78 and into the void 76 encircling the rotatable member 56. The viscous material enters the plurality of channels 74 from the void 76 and continues through the conduit 66. The material is then emitted from the dispense valve 69.

During the dispensing operation, the sixth axis motor 44 rotates the rotatable member 56 and dispense valve 69 as required to properly orient the dispensed bead. The housing 58 remains essentially stationary with respect to the rotatable member 56 as the orienting of the dispense nozzle 69 proceeds via the roller bearings 92 and 94. However, the viscous material may continuously flow through the housing 58 to the rotatable member 56 even during rotation. As such, the material supply line 82 experiences minimal contortions during the dispensing operations.

From the foregoing, it can be seen that compared to prior art methods for reducing material supply line fatigue, the rotary union of the present invention enables a single piece rotatable member to serve as both a mounting structure and a dispense material conduit. Furthermore, the rotatable member is mountable directly to the face plate or face plate adaptor of a multi-axis robot such that the sixth axis motor can power rotational orientation of the dispense valve. Hence, damage caused to material supply lines from repeated flexing and unflexing due to the rotation of the dispense valve is alleviated and the complexity of prior art methods is reduced.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification, and following claims.

What is claimed is:

1. A robotic dispensing apparatus for dispensing a preselected material to a desired location comprising:

a multi-axis robot including a base, said base rotatably supporting a main body portion along a first axis, said main body portion pivotally supporting a support member about a second axis, said support member pivotally supporting an arm about a third axis, said arm having a first end rotatable along a fourth axis with respect to a second end, a wrist member pivotally connected to said arm about a fifth axis, and a face plate rotatably mounted to said wrist along a sixth axis;

a motor disposed along said sixth axis for rotating said face place;

a face plate adapter secured to said face plate by at least one threaded member passing through said face plate adapter and threadingly engaging said face plate;

a rotatable member coupled to said face plate adapter at a first end by at least one threaded member passing through said face plate adapter and threadingly engaging said rotatable member, said rotatable member including a dispense conduit formed therein from a second end;

a housing rotatably supported about said rotatable member such that said rotatable member is rotatable relative to said housing, said housing including an opening formed therein;

a plurality of roller bearings interposed between said housing and said rotatable member for rotatably supporting said housing;

a material supply line coupled to said housing so as to communicate with said opening;

at least one seal sealingly engaging said housing and said rotatable member to fluidly isolate said roller bearings from said opening and said dispense conduit; and said housing including at least one weep hole between said roller bearings and said seal for indicating leaks in said seal.

2. The robotic dispensing apparatus of claim 1 further comprising at least one channel interconnecting said opening and said dispense conduit.

3. The robotic dispensing apparatus of claim 1 wherein said housing further comprises a void encircling said dispense nozzle and interconnecting said dispense conduit and said opening.

4. A rotary union comprising:

a rotatable member having a first end and a second end, said rotatable member being secured to a rotating means at said first end by at least one threaded member threadingly engaging a threaded bore axially formed in said first end, said rotatable member further including a dispense conduit formed therein from said second end;

a plurality of roller bearings interposed between said rotatable member and a housing such that said housing is rotatably supported about said rotatable member and said rotatable member may be rotated relative to said housing by said rotating means, said housing including an opening formed therein communicating with said dispense conduit; and a material supply line coupled to said housing so as to communicate with said opening.

* * * * *